United States Patent [19]

Takahashi et al.

[11] Patent Number: 4,729,942

[45] Date of Patent: Mar. 8, 1988

[54] METHOD FOR FORMING AN IMAGE

[75] Inventors: Osamu Takahashi; Kiyoshi Morimoto, both of Kanagawa, Japan

[73] Assignee: Fuji Photo Film Co., Ltd., Kanagawa, Japan

[21] Appl. No.: 897,899

[22] Filed: Aug. 19, 1986

[30] Foreign Application Priority Data

Aug. 19, 1985 [JP] Japan ..... 60-181419

[51] Int. Cl.[4] ..... G03C 5/54; G03C 1/40

[52] U.S. Cl. ..... 430/351; 430/203; 430/224; 430/225

[58] Field of Search ..... 430/203, 224, 225, 351

[56] References Cited

U.S. PATENT DOCUMENTS

| | | | |
|---|---|---|---|
| 3,579,334 | 5/1971 | Cieciuch et al. | 430/225 |
| 3,982,946 | 9/1976 | Maekawa et al. | 430/225 |
| 4,310,612 | 1/1982 | Mooberry et al. | 430/225 |
| 4,560,644 | 12/1985 | Naito et al. | 430/203 |
| 4,606,991 | 8/1986 | Kawata et al. | 430/203 |
| 4,636,455 | 1/1987 | Aono et al. | 430/203 |

*Primary Examiner*—Richard L. Schilling

*Attorney, Agent, or Firm*—Sughrue, Mion, Zinn, Macpeak and Seas

[57] ABSTRACT

A method for forming an image comprising heating a light-sensitive material comprising a support having provided thereon at least a light-sensitive silver halide and a dye developer in the presence of a base and/or a base precursor after or simultaneously with imagewise exposure to imagewise distribute a mobile non-oxidation type dye developer, wherein the dye developer is a compound having a dye moiety having a ballast group which is split off upon heating in the presence of the base and/or base precursor and a developer moiety against the silver halide in one molecule, is disclosed. According to the method of the present invention, images which are improved in image identification and color separation characteristics are obtained by heat development of the light-sensitive material.

10 Claims, No Drawings

METHOD FOR FORMING AN IMAGE

FIELD OF THE INVENTION

The present invention relates to a method for forming an image, especially to an improvement in the image-forming method by heat development using a dye developer.

BACKGROUND OF THE INVENTION

Japanese Patent Application (OPI) No. 165054/84 describes heat developable light-sensitive materials comprising a combination of a dye developer, i.e., a compound having both a developer for a sliver halide and a dye in one molecule, with a silver halide. (The term "OPI" as used herein means an "unexamined published application".) When the heat developable light-sensitive material is heated in the presence of a base and/or a base precursor after or simultaneously with imagewise exposure, the dye developer is oxidized and immobilized in an area where the development has taken place, whereby an imagewise distribution of a mobile non-oxidation type dye developer is formed in negative relation to the silver image. If this mobile non-oxidation type dye developer is transferred to a dye-fixing material, a dye image is formed in positive relation to the original.

However, since the dye developer as used in the heat developable light-sensitive material easily diffuses under an alkaline condition, it moves to other layers at a stage which is too soon before it has been immobilized upon the reaction with the exposed silver halide, whereby the density of a light part which should have essentially become white becomes high, resulting in worsening not only the image identification but also the color separation.

SUMMARY OF THE INVENTION

An object of the present invention is to provide a method for forming an image which is improved in image identification and color separation characteristics.

This object of the present invention can be attained by a method for forming an image comprising heating a light-sensitive material comprising a support having provided thereon at least a light-sensitive silver halide and a dye developer in the presence of a base and/or a base precursor after or simultaneously with imagewise exposure to imagewise distribute a mobile non-oxidation type dye developer, wherein the dye developer is a compound having a dye moiety having a ballast group which is split off upon heating in the presence of the base and/or base precursor and a developer moiety against the silver halide in one molecule.

DETAILED DESCRIPTION OF THE INVENTION

The dye developer used in the present invention contains a ballast group which is split off upon heating in the presence of a base and/or a base precursor in the dye moiety thereof. The presence of the ballast group is effective for the prevention of the movement of the dye developer to other layers at a stage that is too soon before it has been immobilized by heat development, whereby high image identification and color separation characteristics can be attained.

The ballast group is preferably an ester group having 5 or more carbon atoms. By the introduction of the ballast group having such high carbon atoms, the split-off (hydrolysis) of the ballast group during the preservation of the light-sensitive material can be prevented and, therefore, the preservability is greatly improved. Further, the split-off of the ballast group in the heat development proceeds in a good timing in view of relation of immobilization by the reaction with a silver halide (that is, the split-off of the ballast group occurs somewhat later than the immobilization) and, thus, the image identification and color separation characteristics can be further improved. In this connection, it is extremely difficult to hydrolyze ester groups having higher carbon atoms in a conventional color diffusion transfer process where the development is carried out in a wet state at room temperature or so (as described, for example, in U.S. Pat. No. 3,230,082). According to the present invention, the hydrolysis easily occurs (without necessity of any special supplement of water from the outside) perhaps for the reason that the heat development is carried out and, therefore, the above-described merits can be attained.

Examples of the image-forming dye which can be used for the dye moiety of the dye developer of the present invention include azo dyes, azo-methine dyes, anthraquinone dyes, naphthoquinone dyes, styryl dyes, nitro dyes, quinoline dyes, carbonyl dyes, phthalocyanine dyes, xanthene dyes, and the like, either chelated or nonchelated.

Examples of usable yellow dyes are described in U.S. Pat. Nos. 3,597,200, 3,309,199, 4,013,633, 4,245,028, 4,156,609, 4,139,383, 4,195,992, 4,148,641, 4,148,643, and 4,336,322, Japanese Patent Application (OPI) Nos. 114930/76 and 71072/81, *Research Disclosure,* RD No. 17630 (December 1978), and ibid., RD No. 16475 (December 1977).

Examples of usable magenta dyes are described in U.S. Pat. Nos. 3,453,107, 3,544,545, 3,932,380, 3,931,144, 3,932,308, 3,954,476, 4,233,237, 4,255,509, 4,250,246, 4,142,891, 4,207,104, and 4,287,292, Japanese Patent Application (OPI) Nos. 106727/77, 23628/78, 36804/80, 73057/81, 71060/81, 134/80, 123538/81, and 113779/81.

Examples of usable cyan dyes are described in U.S. Pat. Nos. 3,482,972, 3,929,760, 4,013,635, 4,268,625, 4,171,220, 4,242,435, 4,142,891, 4,195,994, 4,147,544, and 4,148,642, British Pat. No. 1,551,138, Japanese Patent Application (OPI) Nos. 99431/79, 8827/77, 47823/78, 143323/78, 99431/79, and 71061/81, European Patent (EPC) Nos. 53,037 and 53,040, Japanese Patent Application (OPI) No. 165054/84, *Research Disclosure,* RD No. 17630 (December 1978), ibid., RD No. 16475 (December 1977), etc.

Image-forming dyes are required to have hues suited for color reproduction, to have high molecular extinction coefficients, to be stable against light, heat, and dye-releasing acids and other additives present in the system, and to be easy to synthesize. Examples of the preferred image-forming dyes satisfying these requirements are described in Japanese Patent Application (OPI) No. 165054/84.

A dye capable of forming a metal chelate may be used to form a chelate dye in a dye-fixing layer containing a metal salt (after-chelating).

Dyes of this type are described, for example, in U.S. Pat. Nos. 4,250,238, 4,346,155, 4,346,161, 4,357,410, 4,357,412, 4,419,435, 4,420,550, 4,407,931, and 4,436,799, and Japanese Patent Application (OPI) Nos.

35533/78, 53329/80, 146250/82, 58149/82, 158637/82, 58149/82, 185433/82, 146250/82, 185040/82, 158637/82, 185040/82, 158637/82, 185039/82, 182738/82, 181546/82, 163938/83, 123537/83, 163938/83, 17436/83, 17437/83, 17438/83, 209741/83, 209742/83, 48765/84, and 7950/84.

The above-described ballast group is preferably bound to the conjugated system of the above-described dye moiety.

The developer moiety in the dye developer preferably comprises the same group as $R^3$ which is described hereinafter.

Among the above-described dye developers, compounds of the following formula (I) are especially preferred:

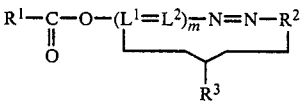

(I)

In the formula (I), $R^1$ represents an unsubstituted or substituted alkyl group, an unsubstituted or substituted aryl group, or an unsubstituted or substituted heterocyclic group, each having 4 or more carbon atoms.

Substituents in the substituted alkyl group are a halogen atom, a nitro group, a cyano group, an alkoxy group, an aryloxy group, an alkylsulfonyl group, an arylsulfonyl group, a carbamoyl group, a sulfamoyl group, an acylamino group, an alkylsulfonylamino group, and an arylsulfonylamino group.

Substituents in the substituted aryl group and the substituted heterocyclic group are a halogen atom, a nitro group, a cyano group, an alkoxy group, an sulfamoyl group, an acylamino group, an alkylsulfonylamino group, and an arylsulfonylamino group.

The compounds of the formula (I) contains an ester group in which $R^1$ is a group having 4 or more carbon atoms and, therefore, these scarcely move to other layers during the preservation or the heat development. More preferably, when $R^1$ is a benzene ring, an aromatic ring, or a heterocyclic ring, it is especially preferably substituted by an substituent(s) having 3 or more, especially 6 or more, in the total carbon atom number. In the case that $R^1$ is an alkyl group, it preferably has 6 or more in the total carbon atom number.

In the formula (I), $L^1$ and $L^2$ each represents a methine group or a substituted methine group. Alternatively, $L^1$ and $L^2$ may together form a member of an at least partially unsubstituted carbocyclic or heterocyclic ring system.

In the formula (I), n is 1 or 2.

In the formula (I), preferred examples of $-(L^1{=}L^2)_n-$ are given below.

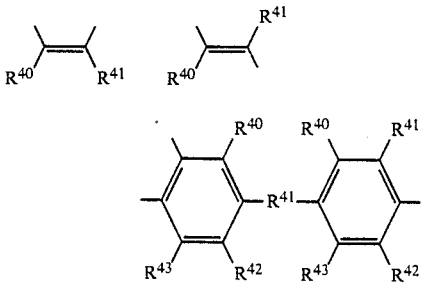

-continued

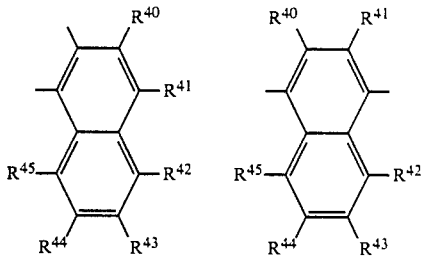

In the above formula, $R^{40}$ through $R^{45}$ each represents a hydrogen atom, a halogen atom, a hydroxyl group, a nitro group, a cyano group, or a substituted or unsubstituted alkyl, aryl, alkoxycarbonyl, aryloxycarbonyl, alkoxy, aryloxy, acylamino, alkylsulfonylamino, arylsulfonylamino, carbamoyl, sulfamoyl, alkylthio, arylthio, alkylsulfonyl, or arylsulfonyl group. The same substituents are substituted on the above-described $R^1$ may be adapted to the groups of $R^{40}$ through $R^{45}$.

In the formula (I), $R^2$ represents

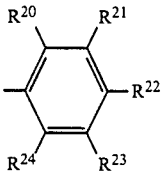

wherein $R^{20}$ through $R^{24}$ each represents a hydrogen atom, a halogen atom, a nitro group, a cyano group, or a substituted or unsubstituted alkyl, aryl, alkoxy, alkylsulfonyl, arylsulfonyl, carbamoyl, sulfamoyl, acylamino, alkylsulfonylamino, or arylsulfonylamino group.

The same substituents as substituted on the above-described $R^1$ may be adapted to the groups of $R^{20}$ through $R^{24}$.

In the formula (I), $R^3$ represents a group selected from:

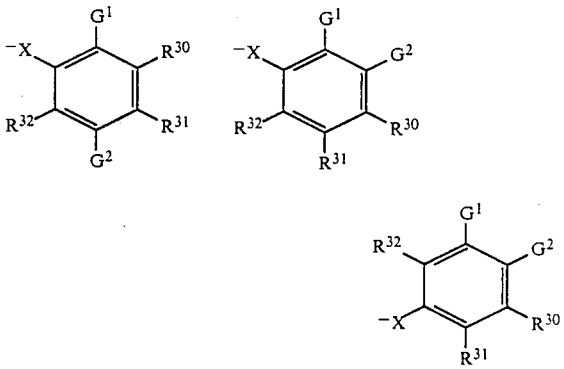

In these formulae, X represents a single bond or a divalent residual group to bind the developer moiety and the dye moiety. Examples of the divalent residual group for X include —alkylene—, —O—, —alkylene—O—, —S—, —alkylene—S—,

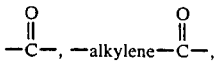

—$SO_2$—, —alkylene—$SO_2$—, —NHCO—, —alkylene—NHCO—, —$NHSO_2$—, —alkylene—$SO_2NH$—, —alkylene—$NHSO_2$—, —alkylene—CONH—, —NHCONH—,

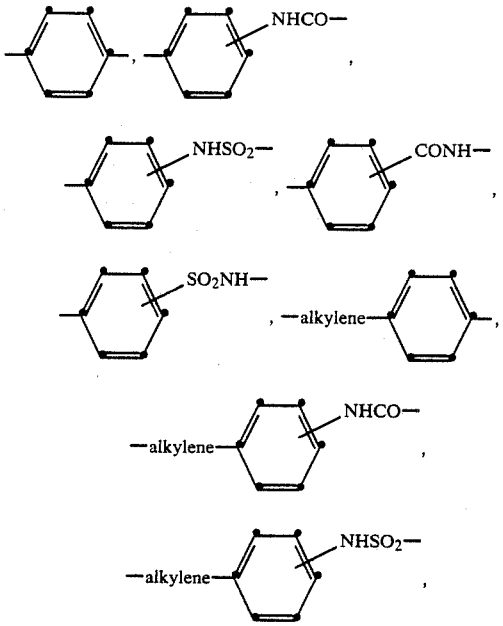

-continued

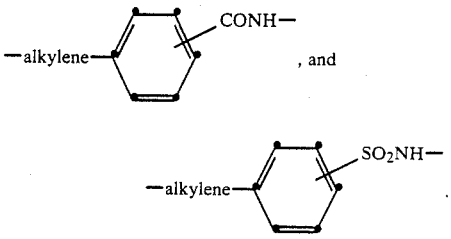

X is bonded to any part of $L^1$, $L^2$, and $R^2$.

$G^1$ and $G^2$ each represents a hydroxyl group or a group capable of forming a hydroxyl group by the action with a nucleophilic reagent under heat (such as an acyloxy group or a carbamoyloxy group); and these $G^1$ and $G^2$ may be the same or different.

$R^{30}$ through $R^{32}$ each represents a hydrogen atom, a halogen atom, a hydroxyl group, or a substituted or unsubstituted alkyl, aryl, alkoxy, aryloxy, acyl, acylamino, alkylsulfonylamino, arylsulfonylamino, alkylthio, carbamoyl, sulfamoyl, or arylthio group. The same substituents as substituted on the above-described $R^1$ may be adapted to the groups of these $R^{30}$ through $R^{32}$.

Also, two of the adjacent X, $R^{30}$, $R^{31}$, and $R^{32}$ may form a condensed ring together with the residue of the molecule.

Specific examples of the dye developer used in the present invention are given below, which, however, do not whatsoever restrict the scope of the present invention.

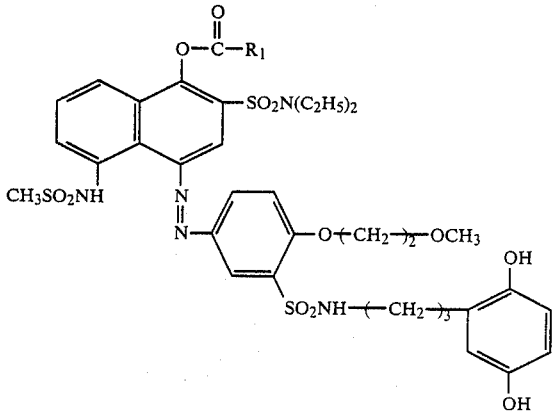

| Compound No. | $R_1$ |
|---|---|
| 1 | 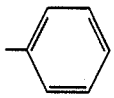 |
| 2 | 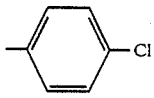 |
| 3 | 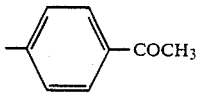 |

-continued
| | |
|---|---|
| 4 | 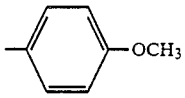 |
| 5 | 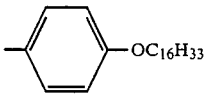 |
| 6 | 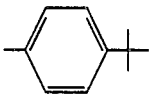 |
| 7 | $-n\text{-}C_4H_9$ |
| 8 | $-tert\text{-}C_4H_9$ |
| 9 | $-C_7H_{15}$ |
| 10 | $-C_{11}H_{23}$ |
| 11 | $-C_{15}H_{31}$ |
| 12 | $-C_{17}H_{35}$ |
| 13 | 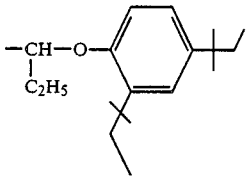 |
| 14 | 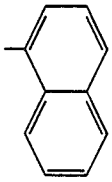 |
| 15 | 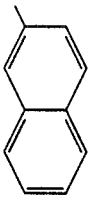 |
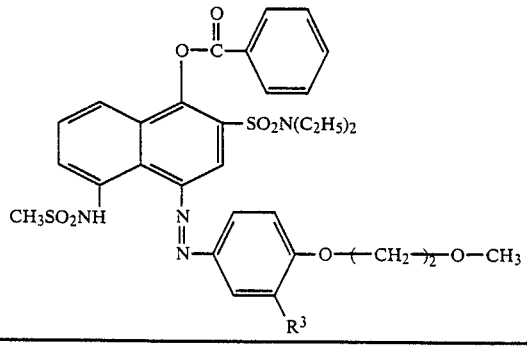
Compound No.

-continued
16
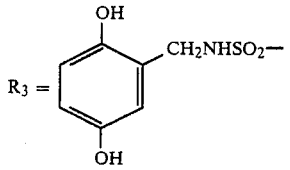
17
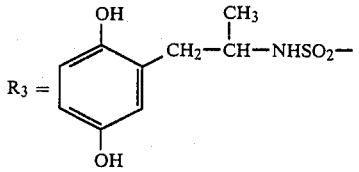
18
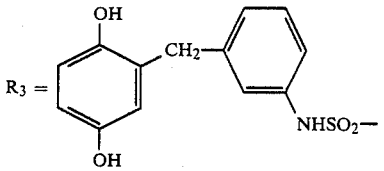
19
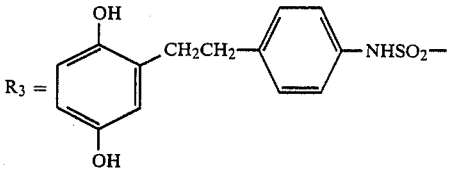
20
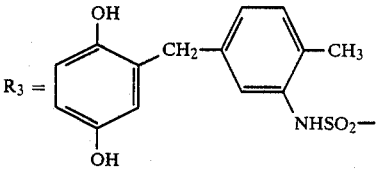
21
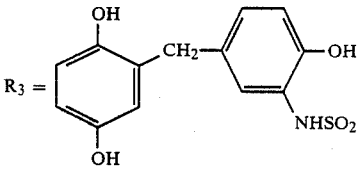
22
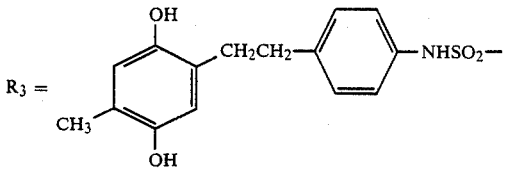
23
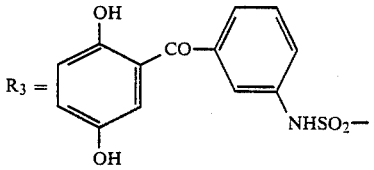

-continued
24
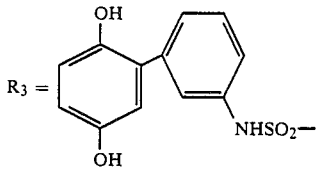
25
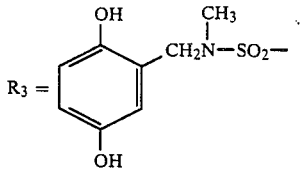
26
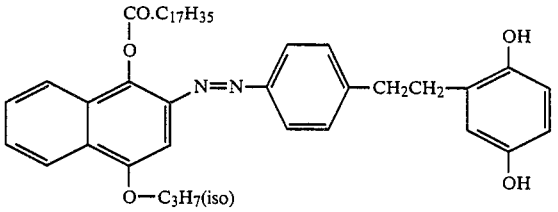
27
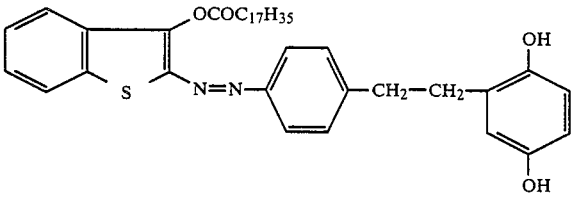
28
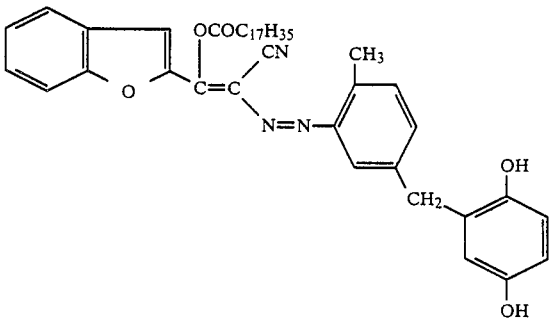
29
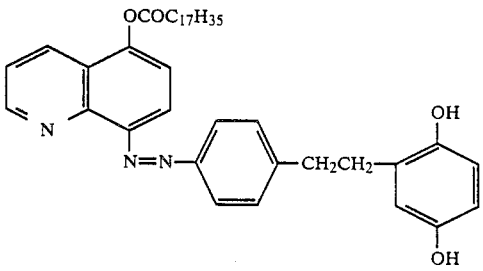

-continued
30
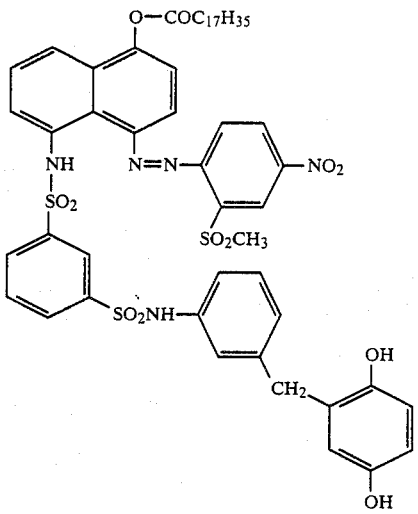
31
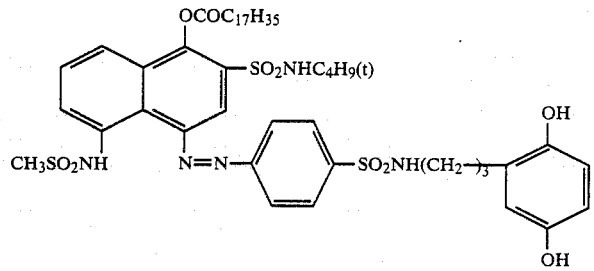
32
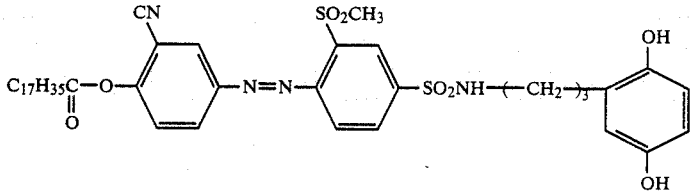
33
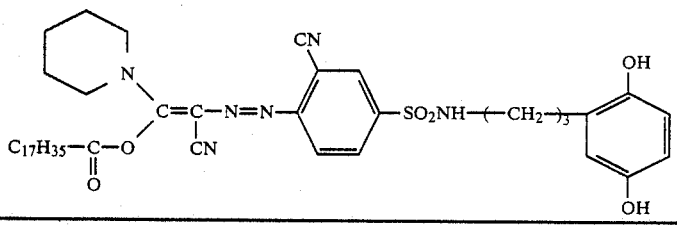
Examples for the synthesis of the compounds of the present invention are given below.
(1) Synthesis of Compound (1)
Pathway of Synthesis:
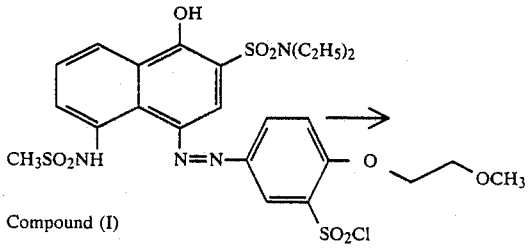
Compound (I)
-continued
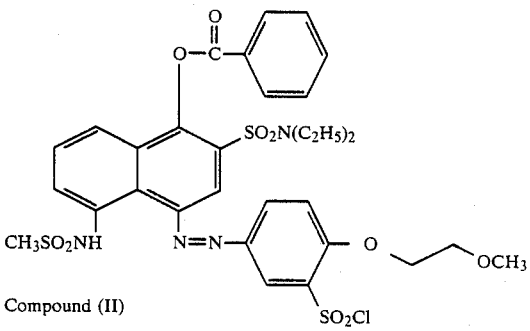
Compound (II)

-continued

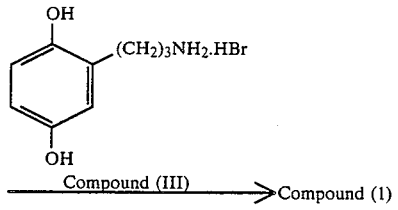

(a) Synthesis of Compound (II):

120 g of Compound (I) was dissolved in 800 ml of dichloromethane, and 78 g of benzoyl chloride was added thereto. Next, 78 ml of triethylamine was gradually added thereto and stirred for 2 hours at room temperature. The reaction mixture was poured into 1000 ml of 1N—HCl for extraction. The resulting extract was dried over Glauber's salt and concentrated, followed by recrystallizing the resulting residue from ethyl acetate to obtain Compound (II). Yield: 84 g (60%).

(b) Synthesis of Compound (1):

3.6 g of Compound (III) was dissolved in 50 ml of dimethylacetamide, and 4 ml of triethylamine was added thereto and, further, 10 g of Compound (II) was gradually added thereto. The whole was stirred for 10 minutes at room temperature and, then, 200 ml of ethyl acetate was added thereto. The ethyl acetate solution was washed twice with 1N—HCl. After being dried, the reaction product was concentrated and purified by silica gel-column chromatography (solvent of chloroform/ethyl acetate=45/55) and finally recrystallized from methanol to obtain Compound (1). Yield: 6.8 g (58%).

(2) Synthesis of Compound (12)

Pathway of Synthesis:

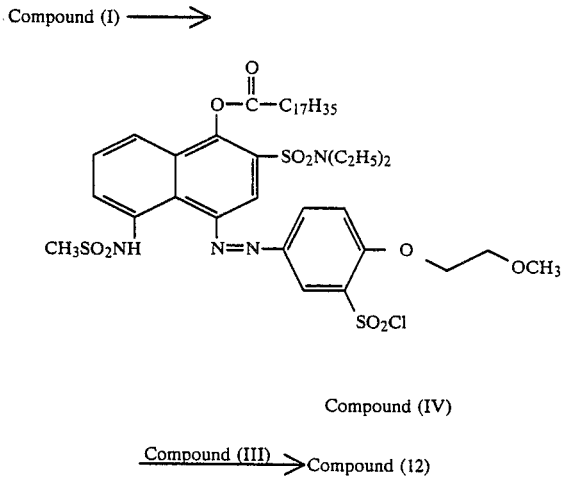

(a) Synthesis of Compound (IV):

30 g of Compound (I) was dissolved in 200 ml of dichloromethane, and 24 g of stearoyl chloride was added thereto. Further, 11 ml of triethylamine was gradually added thereto, and the whole was stirred for 1 hour at room temperature. 200 ml of 1N—HCl was added to the reaction mixture for extraction. The resulting extract was dried over Glauber's salt and concentrated, followed by recrystallizing the product from acetonitrile to obtain Compound (IV). Yield: 24 g (57%).

(b) Synthesis of Compound (12):

3.6 g of Compound (III) was dissolved in 50 ml of dimethylacetamine, and 4 ml of triethylamine was added thereto and, further, 12 g of Compound (IV) was gradually added thereto. The whole was stirred for 10 minutes at room temperature and, then, 200 ml of ethyl acetate was added thereto. The ethyl acetate solution was washed twice with 1N—HCl. After being dried, the solution was concentrated and purified by silica gel-column chromatography (solvent of chloroform/ethyl acetate=2/1) to obtain Compound (12). Yield: 7.5 g (55%).

The other compounds can easily be synthesized in accordance with the methods as described above.

The dye developers of the present invention may be used in combination of two or more thereof. In this case, two or more dye developers may be used to form a particular color, or to form a black color.

The dye developers of the present invention are preferably used in a total amount ranging from 10 ml to 15 g per $m^2$, and more preferably from 15 mg to 5 g per $m^2$.

The dye developers of this invention may be used either in the layer containing a silver halide emulsion or a layer adjacent to an emulsion layer.

In the present invention, a compound which reacts with an oxidation product of a dye developer to inhibit the diffusion of the oxidation product and improve the staining in the high light part, such as active methylene-containing compounds and sulfinic acid derivatives as described in U.S. application Ser. No. 831,675, filed Feb. 21, 1986, can optionally be used, if desired.

In the present invention, a reducing agent is used, if desired. The reducing agent is a so-called auxiliary silver salt developer and is capable of accelerating silver development in co-operation with the dye developer.

Useful auxiliary developers include hydroquinone, alkyl-substituted hydroquinones, e.g., tert-butylhydroquinone, 2,5-dimethylhydroquinone, etc., catechols, pyrogallols, halogen-substituted hydroquinones, e.g., dichlorohydroquinone, etc., alkoxy-substituted hydroquinones, e.g., methoxyhydroquinone, etc., polyhydroxybenzene derivatives, e.g., methylhydroxynaphthalene, etc., and the like. In addition, methyl gallate, ascorbic acid, ascorbic acid derivatives, hydroxylamines, e.g., N,N'-di-(2-ethoxyethyl)-hydroxylamine, etc., pyrazolidones, e.g., 1-phenyl-3-pyrazolidone-4-methyl-4-hydroxymethyl-1-phenyl-3-pyrazolidone, etc., reductones, hydroxytetronic acid, and so on are also useful.

Of these, pyrazolidones are particularly advantageous in view of less stain and noticeable manifestation of the effects of the compounds of formula (I). These auxiliary developers may be precursors thereof that can be activated upon heating or by the action of a base.

The auxiliary developers are used in given concentrations. Preferred concentrations range from 0.0005 to 20 mols, and more preferably from 0.001 to 4 mols, per mol of silver.

The color light-sensitive material according to the present invention is preferably composed of a combination of a blue-sensitive emulsion layer, a green-sensitive emulsion layer, and a red-sensitive emulsion layer, or a combination of a green-sensitive emulsion layer, a red-sensitive emulsion layer, and an infrared-sensitive emulsion layer, each of these layers being combined with a yellow dye developer, a magenta dye developer and a cyan dye developer, respectively. The term "infrared-sensitive emulsion layer" used herein means an emulsion layer sensitive to light having wavelengths of 700 nm or more, and particularly preferably 740 nm or more.

The dye developers of the present invention, especially those of the formula (I), can be used in combination with other conventional dye developers. For instance, the dye developer of the present invention which forms a magenta color can be used while using other conventional dye developers which form an yellow color and a cyan color, respectively. Preferred conventional dye developers with which the dye developers of the present invention can be used in combination are described in Japanese Patent Application (OPI) No. 165054/84.

The silver halide which can be used in the present invention may include any of silver chloride, silver bromide, silver iodide, silver chlorobromide, silver chloroiodide, silver iodobromide, and silver chloroiodobromide.

A halogen composition in the the silver halide grains may be uniform, or the silver halide grains may have a multiple structure in which the composition is different between a surface portion and an inner portion (see Japanese Patent Application (OPI) Nos. 154232/82, 108533/83, 48755/84 and 52237/84, U.S. Pat. No. 4,433,048 and European Pat. No. 100,984, etc.).

Also, a tabular grain silver halide emulsion containing grains having a thickness of 0.5 μm or less, a diameter of at least 0.6 μm and an average aspect ratio of 5 or more (see U.S. Pat. Nos. 4,414,310 and 4,435,499, and West German Patent Application (OLS) No. 3,241,646A1, etc.), and a monodispersed emulsion having a nearly uniform distribution of grain size (see Japanese Patent Application (OPI) Nos. 178235/82, 100846/83 and 14829/83, PCT Application (OPI) No. 83/02338A1, and European Pat. Nos. 64,412A3 and 83,377A1, etc.) may be used in the present invention.

Two or more kinds of silver halides in which a crystal habit, a halogen composition, a grain size and/or a distribution of grain size, etc. are different from each other may be used in mixture. Further, two or more kinds of monodispersed emulsions having different grain size from each other may be employed in mixture to control gradation.

An average grain size of the silver halide used in the present invention is preferably from 0.001 μm to 10 μm, and more preferably from 0.001 μm to 5 μm.

These silver halide emulsions can be prepared by any of an acid process, a neutral process, and an ammonia process. Further, a reaction system of soluble silver salts and soluble halogen salts may be any of a single jet process, a double jet process and a combination thereof. In addition, a reverse mixing process in which silver halide grains are formed in the presence of an excess of silver ions, or a controlled double jet process in which the pAg in the liquid phase is kept constant, can also be utilized.

Moreover, for the purpose of increasing growth of grains, a concentration of addition, the amount of addition and/or speed of addition of silver salts and halogen salts added may be raised (see Japanese Patent Application (OPI) Nos. 142329/80 and 158124/80, and U.S. Pat. No. 3,650,757, etc.).

Furthermore, silver halide grains of epitaxial junction type (see Japanese Patent Application (OPI) No. 16124/81, and U.S. Pat. No. 4,094,684, etc.) may be employed.

In the step for formation of silver halide grains used in the present invention, ammonia, an organic thioether derivative as described in Japanese Patent Publication No. 11386/72, or a compound containing sulfur as described in Japanese Patent Application (OPI) No. 144319/78, etc., can be used as a solvent for silver halide.

In a process of the formation or physical ripening of silver halide grains, a cadmium salt, a zinc salt, a lead salt, or a thallium salt, etc., may coexist. These salts are used for the purposes of improving a change in photographic performance against the pressure, etc. Further, for the purpose of eliminating high-intensity reciprocity failure or low-intensity reciprocity failure, a water-soluble iridium salt such as iridium (III or IV) chloride, ammonium hexachloroiridiate, etc. or a water-soluble rhodium salt such as rhodium chloride, etc., can be used.

Soluble salts may be removed from the silver halide emulsion after precipitate formation or physical ripening, and a noodle washing process or a flocculation process can be used for this purpose.

While the silver halide emulsion may be employed without being subjected to after-ripening, it is usually chemically sensitized. For the chemical sensitization, a sulfur sensitization method, a reduction sensitization method, and a noble metal sensitization method, etc., which are known in the field of emulsions for conventional type photographic light-sensitive materials can be applied alone or in combination therewith. Such a chemical sensitization may be carried out in the presence of a nitrogen-containing heterocyclic compound (see Japanese Patent Application (OPI) Nos. 126526/83 and 215644/83, etc.).

The silver halide emulsion used in the present invention can be that of a surface latent image type in which a latent image is formed mainly on the surface of grains, or that of an internal latent image type in which a latent image is formed mainly in the interior of grains. Further, a direct reversal emulsion in which an internal latent image type emulsion and a nucleating agent are used in combination may be used. Examples of the internal latent image type emulsions suitable for this purpose are described in U.S. Pat. Nos. 2,592,250 and 3,761,276, Japanese Patent Publication No. 3534/83, and Japanese Patent Application (OPI) No. 136641/82, etc. Preferred examples of the nucleating agents suitably used in the present invention are described in U.S. Pat. Nos. 3,227,552, 4,245,037, 4,255,511, 4,266,031 and 4,276,364, and West German Patent Application (OLS) No. 2,635,316, etc.

The coating amount of the light-sensitive silver halide used in the present invention is generally in a range of from 1 mg/m$^2$ to 10 g/m$^2$, calculated as an amount of silver.

In the present invention, an organic metal salt which is relatively stable to light is used as an oxidizing agent together with the light-sensitive silver halide. In this case, it is necessary that the light-sensitive silver halide and the organic metal salt are present in a contact state or in a close relation. Of these organic metal salts, an organic silver salt is particularly preferably used.

The organic metal salt is effective, when the heat-developable light-sensitive material is developed by heating at a temperature of 50° C. or more, and preferably 60° C. or more.

Examples of organic compounds which can be used for forming the above-described organic silver salt oxidizing agent include an aliphatic or aromatic carboxylic acid, a compound containing a mercapto group or a thiocarbonyl group having an α-hydrogen atom, and a compound containing an imino group, etc.

Typical examples of the silver salts of aliphatic carboxylic acids include a silver salt derived from behenic acid, stearic acid, oleic acid, lauric acid, capric acid, myristic acid, palmitic acid, maleic acid, fumaric acid, tartaric acid, Freund's acid, linolic acid, linoleic acid, adipic acid, sebacic acid, succinic acid, acetic acid, butyric acid, propiolic acid, and camphoric acid. Also, a silver salt derived from such an aliphatic carboxylic acid substituted with a halogen atom or a hydroxyl group, or an aliphatic carboxylic acid having a thioether group, etc., can be used.

Typical examples of the silver salts of aromatic carboxylic acids and other carboxyl group-containing compounds include a silver salt derived from benzoic acid, 3,5-dihydroxybenzoic acid, o-methylbenzoic acid, m-methylbenzoic acid, p-methylbenzoic acid, 2,4-dichlorobenzoic acid, acetamidobenzoic acid, p-phenylbenzoic acid, gallic acid, tannic acid, phthalic acid, terephthalic acid, salicylic acid, phenylacetic acid, pyromellitic acid, and 3-carboxymethyl-4-methyl-4-thiazolin-2-thione, etc.

Examples of the silver salts of compounds containing a mercapto group or a thiocarbonyl group include a silver salt derived from 3-mercapto-4-phenyl-1,2,4-triazole, 2-mercaptobenzimidazole, 2-mercapto-5-aminothiadiazole, 2-mercaptobenzothiazole, an S-alkyl thioglycolic acid (wherein the alkyl group has from 12 to 22 carbon atoms), a dithiocarboxylic acid such as dithioacetic acid, etc., a thioamide such as thiostearoylamide, etc., 5-carboxyl-1-methyl-2-phenyl-4-thiopyridine, and a mercapto compound such as mercaptotriazine, 2-mercaptobenzoxazole, or mercaptooxadiazole, etc., as described in U.S. Pat. No. 4,123,274, etc.

Typical examples of the silver salts of compounds containing an imino group include a silver salt derived from a benzotriazole or a derivative thereof as described in Japanese Patent Publication Nos. 30270/69 and 18416/70, for example, benzotriazole, an alkyl-substituted benzotriazole such as methylbenzotriazole, etc., a halogen-substituted benzotriazole such as 5-chlorobenzotriazole, etc., a carboimidobenzotriazole such as butylcarboimidobenzotriazole, etc., a nitrobenzotriazole as described in Japanese Patent Application (OPI) No. 118639/83, sulfobenzotriazole, carboxybenzotriazole or a salt thereof, hydroxybenzotriazole, etc., as described in Japanese Patent Application (OPI) No. 118638/83, a 1,2,4-triazole or a 1H-tetrazole as described in U.S. Pat. No. 4,220,709, a carbazole, a saccharin, an imidazole and a derivative thereof, etc.

Moreover, a silver salt as described in *Research Disclosure,* RD No. 17029 (June, 1978), an organic metal salt other than a silver salt, such as copper stearate, etc., and a silver salt of a carboxylic acid which is heat decomposable such as phenylpropiolic acid, etc. as described in Japanese Patent Application No. 221535/83 are also used in the present invention.

The organic silver salt and organic metal salt described above can be employed in a range from 0.01 mol to 10 mols and preferably from 0.01 mol to 1 mol, per mol of the light-sensitive silver halide. The total coating amount of the light-sensitive silver halide and the organic silver salt and organic metal salt is suitably from 50 mg/m$^2$ to 10 g/m$^2$.

The silver halide used in the present invention can be spectrally sensitized with methine dyes or other dyes. Suitable dyes which can be employed include cyanine dyes, merocyanine, dyes, complex cyanine dyes, complex merocyanine dyes, holopolar cyanine dyes, hemicyanine dyes, stytyl dyes, and hemioxonol dyes. Of these dyes, cyanine dyes, merocyanine dyes and complex merocyanine dyes are particularly useful. Any conventionally utilized nucleus for cyanine dyes is applicable to these dyes as a basic heterocyclic nucleus. That is, a pyrroline nucleus, an oxazoline nucleus, a thiazole nucleus, a selenazole nucleus, an aimidazole nucleus, a tetrazole nucleus, a pyridine nucleus, etc., and further, nuclei formed by condensing an alicyclic hydrocarbon ring with these nuclei and nuclei formed by condensing an aromatic hydrocarbon ring with these nuclei, that is, an indolenine nucleus, a benzindolenine nucleus, a benzoselenazole nucleus, a benzimidazole nucleus, a quinoline nucleus, etc., are appropriate. The carbon atoms of these nuclei may also be substituted.

To merocyanine dyes and complex merocyanine dyes, as nuclei having a ketomethylene structure, 5- or 6-membered heterocyclic nuclei such as a pyrazolin-5-one nucleus, a thiohydantoin nucleus, a 2-thiooxazolidin-2,4-dione nucleus, a thiazolidin-2,4-dione nucleus, a rhodanine nucleus, a thiobarbituric acid nucleus, etc., may also be applicable.

These sensitizing dyes can be employed individually, and can also be employed in combinations thereof. A combination of sensitizing dyes is often used, particularly for the purpose of supersensitization.

The sensitizing dyes may be present in the emulsion together with dyes which themselves do not give rise to spectrally sensitizing effects but which exhibit a supersensitizing effect or materials which do not substantially absorb visible light but which exhibit a supersensitizing effect. For example, aminostilbene compounds substituted with a nitrogen-containing heterocyclic group (for example, those described in U.S. Pat. Nos. 2,993,390 and 3,635,721, etc.), aromatic organic acid-formaldehyde condensates (for example, those described in U.S. Pat. No. 3,743,510, etc.), cadmium salts, azaindene compounds, etc., can be present. The combinations as described in U.S. Pat. Nos. 3,615,613, 3,615,641, 3,617,295 and 3,635,721 are particularly useful.

In order to incorporate the sensitizing dye into a silver halide photographic emulsion, it may be directly dispersed in the silver halide emulsion or it may be dissolved in a solvent such as water, methanol, ethanol, acetone, methyl cellosolve, etc., individually or as a mixture thereof, and then the solution is added to the silver halide emulsion. Further, the sensitizing dye is dissolved in a solvent which is substantially immiscible with water such as phenoxyethanol, etc., the solution is then dispersed in water or a hydrophilic colloid and thereafter the dispersion is added to the silver halide emulsion. Mroeover, the sensitizing dye is mixed with an oleophilic compound such as a dye providing compound, etc., and added simultaneously to the silver halide emulsion.

In the case of using a combination of the sensitizing dyes, these sensitizing dyes may be separately dissolved or a mixture thereof may be dissolved. Furthermore, these sensitizing dyes may be added separately or simultaneously as a mixture to the silver halide emulsion. They may be added together with other additives to the emulsion.

The period for the addition of the sensitizing dye to the silver halide emulsion may be before, during, or after the chemical ripening, or before, during or after the formation of silver halide grains as described in U.S. Pat. Nos. 4,183,756 and 4,225,666.

The amount added is generally in a range from about $10^{-8}$ mol to about $10^{-2}$ mol per mol of silver halide.

In the present invention, an image formation accelerator can be used. The image formation accelerator has a function which accelerates the oxidation reduction reaction between a silver salt oxidizing agent and a reducing agent, a function which accelerates a reaction of forming a dye, decomposing a dye or releasing a mobile dye from a dye providing substance, etc., or a function which accelerates transfer of a dye from a layer of the light-sensitive material to a dye fixing layer. From the standpoint of a physical or chemical function, they are classified into a group, for example, a base or base precursor, a nucleophilic compound, an oil, a thermal solvent, a surface active agent, a compound having an interaction with silver or a silver ion, etc. However, such groups of substances usually show complex functions and generally show several some of the above described accelerating effects at the same time.

The image formation accelerators other than bases and base precusors are classified depending on their function and specific examples thereof are set forth below. However, such a classification is only for convenience, and, as noted above, in practice a compound may often have multiple function.

(a) Nucleophilic compound

Examples of the nucleophilic compounds include water, a water releasing compound, an amine, an amidine, a quanidine, a hydroxylamine, a hydrazine, a hydrazide, an oxime, a hydroxamic acid, a sulfonamide, an active methylene compound, an alcohol, a thiol, etc. Further, salts or precursors of the above described compounds may be employed.

(b) Oil

An organic solvent having a high boiling point (so-called plasticizer) which can be used as a solvent for dispersion of a hydrophobic compound is employed.

(c) Thermal solvent

The thermal solvent is a compound which is solid at an ambient temperature, but melts at a desired development temperature to act as a solvent. Examples of the thermal solvents include compounds which are selected from a urea, a urethane, an amide, a pyridine, a sulfonamide, a sulfone, a sulfoxide, an ester, a ketone and an ether and which are solid at 40° C. or below.

(d) Surface active agent

Examples of the surface active agents include a pyridinium salt, an ammonium salt, and a phosphonium salt as described in Japanese Patent Application (OPI) No. 74547/84, etc., and a polyalkylene oxide as described in Japanese Patent Application (OPI) No. 57231/84, etc.

(e) Compound having an interaction with silver or a silver ion

Examples of such compounds include an imide, a nitrogen-containing heterocyclic compound as described in Japanese Patent Application (OPI) No. 177550/84, a thiol, a thiourea, and a thioether as described in Japanese Patent Application (OPI) No. 111636/84, etc.

The image formation accelerator may be incorporated into either a light-sensitive material or a dye fixing material, or both of them. Further, it may be incorporated into any of an emulsion layer, an intermediate layer, a protective layer, an image receiving layer (a dye fixing layer) and a layer adjacent thereto. The above descriptions are true in an embodiment wherein a light-sensitive layer and a dye fixing layer are provided on the same support.

The image formation accelerators may be employed individually or in a mixture of two or more thereof. In general, a great accelerating effect is obtained when two or more kinds thereof are employed in mixture. Particularly, when a base or base precursor is employed together with other kinds of the accelerators, a remarkable accelerating effect is revealed.

In the present invention, various kinds of development stopping agents are used for the purpose of obtaining a constant image irrespective of variation in a processing temperature and a processing time at the development.

The term "development stopping agent" used herein means a compound which can rapidly neutralize a base or react with a base to decrease concentration of the base in the layer when the development has appropriately proceeded whereby the development is stopped or a compound which can interact with silver or a silver salt and inhibit the development.

Examples of the development stopping agents include an acid precursor which releases an acid by heating, an electrophilic compound which causes a displacement reaction with a base coexistent by heating, a nitrogen-containing heterocyclic compound, a mercapto compound, and a precursor thereof, etc.

Examples of the acid precursors include an oxime ester as described in Japanese Patent Application (OPI) Nos. 108837/85 and 192939/85, a compound which releases an acid upon a Lossen rearrangement as described in Japanese Patent Application (OPI) No. 230133/85, etc.

Examples of the electrophilic compounds which cause a displacement reaction with bases by heating include a compound as described in Japanese Patent Application (OPI) No. 230134/85, etc.

Further, the compounds which releases a mercapto compound by heating are useful and include those described in U.S. patent aplication Ser. Nos. 774,427 (filed Sept. 10, 1985), 809,627 (filed Dec. 16, 1985), 799,996 (filed Nov. 20, 1985), 827,139 (filed Feb. 7, 1986), 829,032 (filed Feb. 13, 1986), 828,481 (filed Feb. 12, 1986) and 830,031 (filed Feb. 18, 1986), Japanese Patent Application (OPI) No. 53632/86, etc.

It is preferred that the above described development stopping agent is employed together with the base precursor since its effect is particularly achieved.

In such a case, the ratio (molar ratio) of base precursor/acid precursor is preferably in a range from 1/20 to 20/1, and more preferably in a range from 1/5 to 5/1.

Further, in the present invention, it is possible to use a compound which activates development simultaneously while stabilizing the image. Particularly, it is preferred to use an isothiuronium including 2-hydroxyethylisothiuronium trichloroacetate, etc., as described in U.S. Pat. No. 3,301,678, a bis(isothiuronium) including 1,8-(3,6-dioxaoctane) bis(isothiuronium trichloroacetate), etc., as described in U.S. Pat. No. 3,669,670, a thiol compound as described in West German Patent Application (OLS) No. 2,162,714, a thiazolium compound such as 2-amino-2-thiazolium trichloroacetate, 2-amino-5-bromoethyl-2-thiazolium trichloroacetate, etc., as described in U.S. Pat. No. 4,012,260, a compound having an α-sulfonylacetate as an acidic component, such as bis(2-amino-2-thiazolium)methylenebis(-sulfonylacetate), 2-amino-2-thiazolium phenylsulfonylacetate, etc., as described in U.S. Pat. No. 4,060,420, etc.

Moreover, an azole thioether and a blocked azolinethione compound as described in Belgian Pat. No. 768,071, a 4-aryl-1-carbomyl-2-tetrazolin-5-thione compound as described in U.S. Pat. No. 3,893,859, and a compound as described in U.S. Pat. No. 3,839,041, 3,844,788 and 3,877,940 are also preferably employed.

In the present invention, various kinds of anti-fogging agents can be employed. Examples of useful anti-fogging agents include an azole, a carboxylic acid and a phosphoric acid each containing a nitrogen atom as described in Japanese Patent Application (OPI) No. 168442/84, a mercapto compound and a metal salt thereof as described in Japanese Patent Application (OPI) No. 111636/84, etc. Such an antifogging agent is generally used in a concentration range from 0.001 mol to 10 mols per mol of silver.

In the present invention, image toning agents can be incorporated, if desired. Effective toning agents are compounds such as phthaladinones, 1,2,4-triazoles, 1H-tetrazoles, thiouracils and 1,3,4-thiadiazoles, etc. Examples of preferred toning agents include 5-amino-1,3,4-thiadiazole-2-thiol, 3-mercapto-1,2,4-triazole, bis(dimethylcarbamyl)disulfide, 6-methylthiouracil and 1-phenyl-2-tetrazolin-5-thione, etc. Particularly effective toning agents are compounds which can form black images.

The concentration of the toning agents incorporated varies according to the kind of heat-developable light-sensitive material, processing conditions, images to be required, and other factors, but it is generally in a range of from about 0.001 mol to 0.1 mol per mol of silver in the light-sensitive material.

The binder which can be used in the present invention can be employed individually or in a combination thereof. A hydrophilic binder can be used as the binder according to the present invention. The typical hydrophilic binder is a transparent or translucent hydrophilic colloid, examples of which include a natural substance, for example, a protein such as gelatin or a gelatin derivative, a cellulose derivative, a polysaccharide such as starch, gum arabic, etc., and a synthetic polymer compound, for example, a water-soluble polyvinyl compound such as polyvinyl pyrrolidone, acrylamide polymer, etc. Another example of the synthetic polymer compound is a dispersed vinyl compound in a latex form which is used for the purpose of increasing dimensional stability of a photographic material.

In addition, the compounds as described in *Research Disclosure,* page 26, IXA (December, 1978) can be so employed.

A suitable coating amount of the binder according to the present invention is generally 20 g/m$^2$ or less, preferably 10 g/m$^2$ or less, and more preferably 7 g/m$^2$ or less.

A suitable ratio of the organic solvent having a high boiling point which is dispersed in a binder together with a hydrophobic compound such as a dye providing substance to the binder is 1 ml or less, preferably 0.5 ml or less, and more preferably 0.3 ml or less, per g of the binder.

In the heat-developable light-sensitive material and the dye fixing material according to the present invention, the photographic emulsion layer, the above described electrically conductive layer, the dye fixing layer and other binder layers may contain an inorganic or organic hardener. It is possible to use a chromium salt (e.g., chromium alum, chromium acetate, etc.), an aldehyde (e.g., formaldehyde, glyoxal, glutaraldehyde, etc.), an N-methylol compound (e.g., dimethylolurea, methylol dimethylhydantoin, etc.), a dioxane derivative (e.g., 2,3-dihydroxydioxane, etc.), an active vinyl compound (e.g., 1,3,5-triacryloylhexahydro-s-triazine, 1,3-vinylsulfonyl-2-propanol, 1,2-bis(vinylsulfonylacetamide)ethane, etc.), an active halogen compound (e.g., 2-4-dichloro-6-hydroxy-1,3,5-triazine, etc.), a mucohalogenic acid (e.g., mucochloric acid, mucophenoxychloric acid, etc.), etc., which are used individually or as a combination thereof.

A support used in the heat-developable light-sensitive material and the dye fixing material employed, if desired, according to the present invention is that which can endure at the processing temperature. As an oridinary support, not only glass, paper, metal or analogues thereof may be used, but also an acetyl cellulose film, a cellulose ester film, a polyvinyl acetal film, a polystyrene film, a polycarbonate film, a polyethylene terephthalate film, and a film related thereto or a resin material may be used. Further, a paper support laminated with a polymer such as polyethylene, etc., can be used. Polyesters as described in U.S. Pat. Nos. 3,634,089 and 3,725,070 are preferably used.

In the present invention, in order to increase sharpness of images, a filter dye or an absorbing substance, etc., as described in Japanese Patent Publication No. 3692/73, U.S. Pat. Nos. 3,253,921, 2,527,583 and 2,956,879, etc., can be incorporated into the light-sensitive material used in the present invention. It is preferred for such a dye to lose its color upon heating. For example, dyes as described in U.S. Pat. Nos. 3,769,019, 3,745,009 and 3,615,432, etc., are preferably employed.

The light-sensitive material which can be used in the present invention may contain, if desired, various additives which are known to use in heat-developable light-sensitive materials, and layer other than the light-sensitive layer, for example, a protective layer, an intermediate layer, an antihalation layer, a stripping layer, etc. Various additives which can be used include those as described in *Research Disclosure,* Vol. 170, RD No. 17029 (June, 1978), for example, a plasticizer, a sharpness-improving dye, an antihalation dye, a matting agent, a surface active agent, a fluorescent whitening agent, a color fading prevent agent, etc.

The photographic element according to the present invention is composed of a light-sensitive element which forms or releases a dye upon development by heating, and, if desired, a dye fixing element for fixing a dye. Particularly in a system wherein images are formed by diffusion transfer of dyes, both the light-sensitive element and the dye fixing element are essential. Typical photographic elements employed in such a system are divided broadly into two embodiments, that is, an embodiment in which the light-sensitive element and the dye fixing element are provided on two supports separately, and an embodiment in which the both elements are provided on the same support.

The embodiment in which the light-sensitive element and the dye fixing element are formed on different supports is further classified into two types. Specifically, one is a peel-apart type, and the other is a non-peel-apart type.

In the case of the peel-apart type, a coated surface of the light-sensitive element and a coated surface of the dye fixing element are superposed on each other after imagewise exposure or heat development, and then after formation of transferred images the light-sensitive element is rapidly peeled apart from the dye fixing element. A support of the dye fixing element is selected from an opaque support and a transparent support depending on the fact that whether the final image is a reflective type or a transmitting type. Further, a white reflective layer may be provided on the support, if desired.

In case of the latter non-peel-apart type, it is necessary that a white reflective layer is present between a light-sensitive layer of the light-sensitive element and a dye fixing layer of the dye fixing element. The white reflective layer can be provided in either the light-sensitive element or the dye fixing element. In this case, a support of the dye fixing element is required to be a transparent support.

One representative example of the embodiment in which the light-sensitive element and the dye fixing element are provided on the same support is a type in which the light-sensitive element is not necessary to peel apart from the image receiving element after the formation of transferred images. In such a case, on a transparent or opaque support a light-sensitive layer, a dye fixing layer and a white reflective layer are superposed. Examples of preferred embodiments of layer structure include transparent or opaque support/light-sensitive layer/white reflective layer/dye fixing layer, or transparent support/dye fixing layer/white reflective layer/light-sensitive layer, etc.

Another typical example of the embodiment in which the light-sensitive element and the dye fixing element are provided on the same support is a type in which a part or all of the light-sensitive element is separated from the dye fixing element and a stripping layer is provided on an appropriate position of the element as described, for example, in Japanese Patent Application (OPI) No. 67840/81, Canadian Pat. No. 674,082, U.S. Pat. No. 3,730,718, etc.

The light-sensitive element or the dye fixing element may form a structure having an electrically conductive heat generating layer suitable for use as heating means for the purpose of heat development or diffusion transfer of dyes.

In order to reproduce a large range of color in a chromaticity diagram using three elementary colors, i.e., yellow, magenta, and cyan, it is necessary that the light-sensitive element used in the present invention contains at least three silver halide emulsion layers each having its sensitivity in a spectral region different from each other.

Typical examples of the combination of at least three silver halide emulsion layers each having its sensitivity in a sectral region different from each other include (1) a combination of a blue-sensitive emulsion layer, a green-sensitive emulsion layer, and a red-sensitive emulsion layer, (2) a combination of a green-sensitive emulsion layer, a red-sensitive emulsion layer, and an infrared light-sensitive emulsion layer, (3) a combination of a blue-sensitive emulsion layer, a green-sensitive emulsion layer, and an infrared light-sensitive emulsion layer, (4) a combination of a blue-sensitive emulsion layer, a red-sensitive emulsion layer and an infrared light-sensitive emulsion layer, etc. The reference to an infrared light-sensitive emulsion layer as used herein means an emulsion layer having a sensitivity maximum in a region of 700 nm or more particularly in a region of 740 nm or more.

The light-sensitive material used in the present invention may also have two or more light-sensitive emulsion layers which are sensitive to light of the same spectral region but have different sensitivities, if desired.

It is necessary for the production of natural color images that each of the above described emulsion layers and/or light-insensitive hydrophilic colloid layers adjacent to the emulsion layers contains at least one kind of a dye providing substance capable of releasing or forming a yellow hydrophilic dye, a dye providing substance capable of releasing or forming a magenta hydrophilic dye, and a dye providing substance capable of releasing or forming a cyan hydrophilic dye, respectively. In other words, in each of the emulsion layers and/or light-insensitive hydrophilic colloid layers adjacent to the emulsion layers, dye providing substances capable of releasing or forming hydrophilic dyes having different hues from each other should be incorporated, respectively. If desired, two or more kinds of dye providing substances having the same hue may be used in mixture. In case of using dye providing substances which are colored originally, it is particularly advantageous that the dye providing substances are incorporated into layers other than the emulsion layer.

The light-sensitive material used in the present invention may contain, if desired, a subsidiary layer, for example, a protective layer, an intermediate layer, an antistatic layer, an anti-curling layer, a stripping layer, a matting layer, etc. in addition to the above described layers.

Particularly, the protective layer (PC) usually contains an organic or inorganic matting agent for the purpose of preventing adhesion. Further, the protective layer may contain a mordant, an ultraviolet light absorbing agent, etc. The protective layer and the intermediate layer may be composed of two or more layers, respectively.

Moreover, the intermediate layer may contain a reducing agent for preventing color mixing, an ultraviolet light absorbing agent, a white pigment such as $TiO_2$, etc. The white pigment may be incorporated into the emulsion layer in addition to the intermediate layer, for the purpose of increasing the sensitivity.

In order to impart the spectral sensitivity as described above to the silver halide emulsion, the silver halide emulsion may be spectrally sensitized using the conventional sensitizing dyes so as to obtain the desired spectral sensitivity.

The dye fixing element which can be used in the present invention comprises at least one layer containing a mordant. When the dye fixing layer is positioned on the surface of the dye fixing element, a protective layer can be further provided in the element, if desired.

A water absorbing layer or a layer containing a dye transfer assistant may be provided in order to sufficiently incorporate the dye transfer assistant, if desired, or in order to control the dye transfer assistant. These layers may be provided adjacent to the dye fixing layer or provided through an intermediate layer.

The dye fixing layer used in the present invention may be composed of two or more layers containing mordants which have mordanting powers different from each other, if desired.

The dye fixing element used in the present invention may contain, if desired, a subsidiary layer, for example, a stripping layer, a matting layer, an anti-curling layer, etc., in addition to the above described layers.

Into one or more of the layers described above, a base and/or base precursor for the purpose of accelerating dye transfer, a hydrophilic thermal solvent, a color fading preventing agent for preventing fading of dyes, an ultraviolet light absorbing agent, a dispersed vinyl compound for the purpose of increasing dimensional stability, a fluorescent whitening agent, etc. may be incorporated.

The binder which can be used in the above described layers is preferably a hydrophilic binder. The typical hydrophilic binder is a transparent or translucent hydrophilic colloid, examples of which include a natural substance, for example, a protein such as gelatin, a gelatin derivative, polyvinyl alcohol, a cellulose derivative, etc., a polyaccharide such as starch, gum arabic, etc., and a synthetic polymer compound, for example, dextrin, pullulan, a water-soluble polyvinyl compound such a polyvinyl alcohol, polyvinyl pyrrolidone, acrylamide polymer, etc. Among them, gelatin and polyvinyl alcohol are particularly preferred.

The dye fixing layer employed in the present invention includes a dye fixing layer which can be used in heat-developable color light-sensitive materials. A mordant to be used can be selected appropriately from mordants conventionally used. Among them, polymeric mordants are particularly preferred. The polymeric mordants include polymers containing tertiary amino groups, polymers containing nitrogen-containing heterocyclic moieties, and polymers containing quaternary cationic groups thereof, etc.

Specific examples of polymers containing vinyl monomer units having a tertiary amino group are described in Japanese Patent Application (OPI) Nos. 60643/85 and 57836/85, etc. Specific examples of polymers containing vinyl monomer units having a tertiary imidazole group are described in Japanese Patent Application (OPI) Nos. 118834/85 and 122941/85, U.S. Pat. Nos. 4,282,305, 4,115,124 and 3,148,061, etc.

Specific examples of preferred polymers containing vinyl monomer units having a quaternary imidazolium salt are described in British Pat. Nos. 2,056,101, 2,093,041 and 1,594,961, U.S. Pat. Nos. 4,124,386, 4,115,124, 4,273,853 and 4,450,224, Japanese Patent Application (OPI) No. 28225/73, etc.

Specific examples of other preferred polymers containing vinyl monomer units having a quaternary ammonium salt are described in U.S. Pat. Nos. 3,709,690, 3,898,088, and 3,958,995, Japanese Patent Application (OPI) Nos. 57836/85, 60643/85, 122940/85, 122942/85 and 235134/85, etc.

In the present invention, a transparent or opaque heat generating element used in the case of adopting current heating as a means for development can be prepared utilizing heretofore known techniques with respect to a resistance heat generator.

The resistance heat generator includes a method utilizing a thin layer of an inorganic material exhibiting semiconductor properties, and a method utilizing a thin layer of an organic material composed of electrically conductive fine particles dispersed in a binder. The materials which can be employed in the former method include silicon carbide, molybdenum silicide, lanthanum chromate, barium titanate ceramics used as a PTC thermistor, tin oxide, zinc oxide, etc. These materials can be used to prepare a transparent or opaque thin layer in a known manner. With the latter method, electrically conductive fine particles such as metallic fine particles, carbon black, graphite, etc., are dispersed in a binder such as rubber, a synthetic polymer, gelatin, etc., to prepare a resistor having a desired temperature characteristic. The resistor may be either directly brought into contact with the light-sensitive element or separated by a support or an intermediate layer, etc.

The relationship of positions of the heat generating element and the light-sensitive element are illustrated below.

Heat generating element/support/light-sensitive element

Support/heat generating element/light-sensitive element

Support/heat generating element/intermediate layer/light-sensitive element

Support/light-sensitive element/heat generating element

Support/light-sensitive element/intermediate layer/-heat generating element

The dye fixing element may have a reflective layer containing a white pigment such as titanium oxide, etc., a neutralizing layer, a neutralization timing layer, etc., in addition to the above described layer depending on the purposes. These layers may be provided not only in the dye fixing element, but also in the light-sensitive element. The compositions of these reflective layer, neutralizing layer, and neutralization timing layer are decribed, for example, in U.S. Pat. Nos. 2,983,606, 3,362,819, 3,362,821 and 3,415,644, Canadian Pat. No. 928,559, etc.

It is advantageous that the dye fixing element according to the present invention contains a transfer assistant as described below. The transfer assistant may be incorporated into the above described dye fixing layer or another layer.

A protective layer, an intermediate layer, a subbing layer, a back layer and other layers can be produced by preparing each coating solution and applying it to a support by various coating methods such as a dip coating method, an air-knife coating method, a curtain coating method or a hopper coating method as described in U.S. Pat. No. 2,681,294 and drying in the same manner as used in preparing the light-sensitive layer or the dye fixing layer according to the present invention, by which the light-sensitive material is obtained.

If desired, two or more layers may be applied at the same time by the method as described in U.S. Pat. No. 2,761,791 and British Pat. No. 837,095.

As light sources of imagewise exposure in order to record images on the heat-developable light-sensitive material, radiant rays including visible light can be utilized. Generally, light sources used for conventional color prints can be used, examples of which include tungsten lamps, mercury lamps, halogen lamps such as iodine lamps, xenon lamps, laser light sources, CRT light sources, fluorescent tubes, and light emitting diodes (LED), etc.

According to the present invention, the base and/or base precursor may be incorporated in either the light-sensitive material or the dye-fixing layer if the dye-fixing layer is provided separately from the light-sensitive material. Further, the base and/or base precursor can be supplied from the outside in the form of a solution as dissolved in water or the like solvent.

The bases which can be used in the present invention include inorganic bases such as hydroxides, carbonates, bicarbonates, borates, secondary or tertiary phosphates, quinolinates, and metaborates of alkali metals, alkaline earth metals, and quaternary alkylammoniums, and organic bases such as aliphatic amines, aromatic amines, heterocyclic amines, amidines, cyclic amidines, guanidienes, and cyclic guanidines as well as carbonates, bicarbonates, borates, and secondary or tertiary phosphates thereof.

The base precursors which can be used in the present invention are precursors of the above-described organic bases. The base precursors are referred to herein mean those capable of releasing a basic component upon pyrolysis or electrolysis. For example, salts of pyrolytic organic acids (such as trichloroacetic acid, cyanoacetic acid, acetacetic acid, and α-sulfonylacetic acid) and the above-described organic base and salts of 2-carboxycarboxamide (as described in U.S. Pat. No. 4,088,496) can be mentioned. Further, base precursors as described in British Pat. No. 998,945, U.S. Pat. No. 3,220,846, and Japanese Patent Application (OPI) No. 22625/75 can also be used in the present invention.

Examples of compounds capable of forming a base upon electrolysis include various fatty acids used for typical electrolytic oxidation. By this reaction, carbonates of alkali metals or organic bases such as guanidines or amidines can be formed extremely efficiently. Another means for the electrolysis of the base precursor compounds is electrolytic reduction. The electrolytic reduction includes the formation of amines by reduction of nitro compounds or nitroso compounds, the formation of amines by reduction of nitrile compounds, and the formation of p-aminophenols, p-phenylenediamines, or hydrazines by reduction of nitro compounds, azo compounds, or azoxy compounds. The p-aminophenols, p-phenylenediamines, and hydrazines can be used not only as the base but also as a direct color image-forming substance. Further, the formation of alkaline components by electrolysis of the base precursors with water in the presence of various inorganic salts can also be utilized.

Preferred examples are given below, which, however, are not whatsoever limitative.

Lithium hydroxide, sodium hydroxide, barium hydroxide, sodium carbonate, cesium carbonate, sodium hydrogencarbonate, potassium carbonate, potassium hydrogencarbonate, sodium quinolinate, sodium secondary phosphate, potassium tertiary phosphate, potassium pyrophosphate, sodium metaborate, borax, aqueous ammonia, tetramethylammonium hydroxide, tetraethylammonium hydroxide, $(CH_3)_2NH$, $(C_2H_5)_2NH$, $C_3H_7NH_2$, $HOC_2H_4NH_2$, $(HOC_2H_4)_2NH$, $(HOC_2H_4)_3N$, $H_2NC_2H_4NH_2$, $H_2NC_4H_8NH_2$, $CH_3NHC_2H_4NHCH_3$, $(CH_3)_2NC_3H_6N(CH_3)_2$,

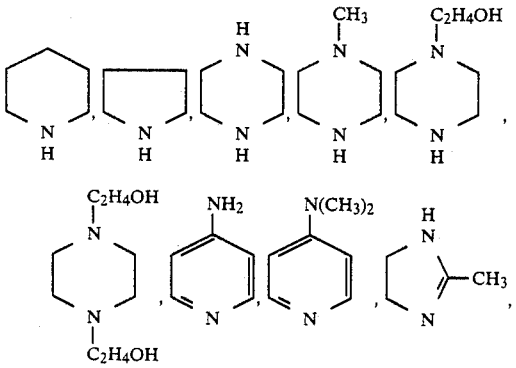

-continued

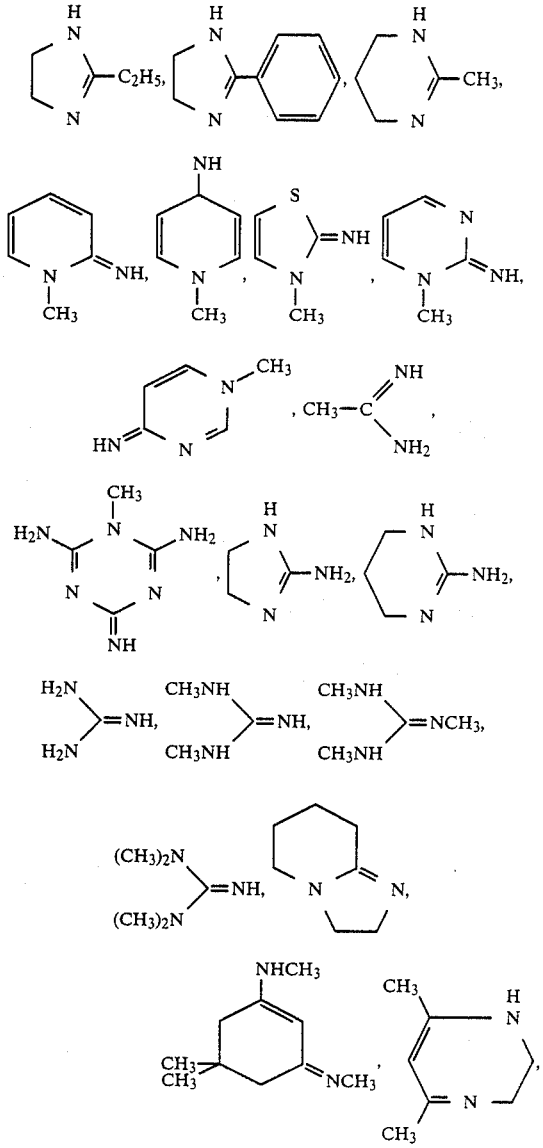

guanidine trichloroacetate, piperidine trichloroacetate, morpholine trichloroacetate, p-toluidine trichloroacetate, 2-picoline trichloroacetate, guanidine carbonate, piperidine carbonate, morpholine carbonate, and tetramethylammonium trichloroacetate.

The base and/or base precursor can be used singly or in admixture of two or more thereof.

The amount of the base and/or base precursor used in the present invention can vary within a broad range. In the case that the base and/or base precursor is used in the light-sensitive layer and/or the dye-fixing layer, the amount is suitably 50 wt.% or less, especially preferably from 0.01 wt.% to 40 wt.%, as calculated in terms of the weight of the coated film. In the case that it is used in the form of a solution as dissolved in water or the like solvent, the concentration is suitably from 0.005 mole/l to 2 mole/l, especially preferably from 0.05 mole/l to 1 mole/l.

Heating means used in development and/or the dye transfer process in the present invention include the previously mentioned heating element, as well as a heating plate, an iron, a heating roller, radiation such as infrared light, ultrasonic wave, and high frequency heating.

In the case that the heating step only is necessary without the transfer step, the heating temperature is from about 50° C. to about 250° C., preferably from 80° to 180° C.

In the present invention, if the transfer of a mobile dye is involved, the transfer process may be conducted separately from the development process or alternatively, both the processes may be simulaneously conducted as described in Japanese Patent Application (OPI) No. 218443/84. Either process is useful.

In the present invention, if a dye providing substance which releases a mobile dye imagewise is used, a dye transfer assistant may be used for transfer of a dye from the light-sensitive layer to the dye fixing layer.

Dye transfer assistants, which are supplied from outside the element, include water, a basic aqueous solution of caustic soda, caustic potash, an inorganic alkali metal salt or an organic base. Bases which may be employed are those described above with reference to the image formation accelerators. Alternatively, a low boiling point solvent such as methanol, N-N-dimethylformamide, acetone, and diisobutyl ketone or a mixture of such solvents and water or a basic aqueous solution may be used. The dye transfer assistant may be used in such a manner that the dye fixing material, the light-sensitive material, or both these materials are wet therewith.

If the dye transfer assistant is originally incorporated in the light-sensitive material or the dye fixing material, the dye transfer assistant is not required to be supplied from outside the element. The dye transfer assistant may be incorporated in the material in the form of water or crystallization or in microcapsules, or in the form of a precursor which releases a solvent at an elevated temperature. More preferably, a hydrophilic thermal solvent which is solid at room or ambient temperature but melts at an elevated temperature may be incorporated in the light-sensitive material or dye fixing material. Such a hydrophilic thermal solvent may be incorporated in either the light-sensitive material or the dye fixing material or both the materials. In particular, the hydrophilic-thermal solvent may be incorporated in any one of the emulsion layer, intermediate layer, protective layer and/or dye fixing layer, preferably the dye fixing layer and/or adjacent layers.

Examples of such a hydrophilic thermal solvent include ureas, pyridines, amides, sulfonamides, imides, alcohols, oximes and other heterocylic compounds.

In the process for conducting development and transfer simulaneously or in sequence, the previously mentioned image formation accelerators and/or dye transfer assistants may be previously incorporated in either the dye fixing material or the light-sensitive material or both the materials of may be supplied from outside the element as described in detail in Japanese Patent Application (OPI) No. 218443/24. In such a process, the heating temperature is in the range of about 50° C. or more, preferably 60° C. or more, and is lower than the boiling point of the solvent used in transfer. For example, if the solvent used for the transfer is water, the heating temperature is preferably in the range of 60° to 100° C., both inclusive.

When the development process and the transfer process are conducted separately, the heating temperature is in the range of about 50° C. to about 250° C., preferably 80° C. to 180° C. In the transfer process, transfer can be conducted at a heating temperature ranging from room temperature to the temperature used in the heat development process, preferably about 50° C., more preferably to the temperature about 10° C. lower than that used in the heat development process.

The addition of the dye transfer assistant to the light-sensitive layer or the dye fixing layer may be accomplished by a roller coating process or a wire bar coating process as described in Japanese Patent Application (OPI) No. 181353/84, process as described in Japanese Patent Application (OPI) No. 181354/84 in which a water-absorbing member is used to apply water to a dye fixing material, a process as described in Japanese Patent Application (OPI) No. 181346/84 in which a bead is formed between a light-sensitive material and a dye fixing material so as to apply a dye transfer assistant to the materials, a process as described in Japanese Patent Application (OPI) No. 181348/84 in which a bead is formed between a water-repellent roller and a dye fixing layer so as to apply a dye transfer assistant to the layer, a dipping process, an extrusion process, a process in which a jet is sprayed through a nozzle to apply a dye transfer assistant to the material, or a process in which a pod is pressed to apply a dye transfer assistant to the material.

As described in Japanese Patent Application (OPI) NO. 16455/84, the dye transfer assistant may be applied in a specified amount which has been previously measured or in excess amount which will be later adjusted to proper value by pressing by a roller or the like or drying by heating.

For example, a dye transfer assistant such as water is applied to a dye fixing material by one of the previously mentioned application methods. The dye fixing material is passed through a gap between pressure rollers so that excess dye transfer assistant is pressed out. The dye fixing layer is then superposed on a light-sensitive material.

The pressure at which the heat developable light-sensitive material and the dye fixing material are superposed on each other so that they are brought into close contact with each other varies with the embodiment and materials used. In general, the pressure is about 0.1 to about 100 kg/cm$^2$, preferably 1 to 50 kg/cm$^2$, as described in Japanese Patent Application (OPI) No. 180547/84.

The application of pressure to the heat developable light-sensitive material and the dye fixing material may be accomplished by passing the materials through a gap between a pair of rollers, pressing the materials by means of smooth plates, or by other various processes. Such rollers or plates may be heated to a temperature ranging from room temperature to the temperature used in the heat development process.

The present invention will be explained in greater detail by reference to the following examples which, however, are not intended to be interpreted as limiting the scope of the present invention. Unless otherwise specified, all percents, ratios, etc., are by weight.

EXAMPLE 1

The following layers were provided on a polyethylene terephthalate film support in order to prepare comparative light-sensitive coated materials (A-1) and (A-2).

Light-sensitive coated material (A-1):

(1) A layer containing silver iodobromide (0.72 g of silver/m$^2$), benzotriazole silver (0.43 g of silver/m$^2$), gelatin (2.84 g/m$^2$), active methylene group-containing compound having the following structure (B) (0.58 g/m$^2$), auxiliary developer having the following structure (C) (0.08 g/m$^2$), anti-foggant having the following structure (E) (0.62 g/m$^2$), base precursor having the following structure (F) (0.62 g/m$^2$), and tricresyl phosphate (1.2 g/m$^2$).

(2) A layer containing gelatin (1.2 g/m$^2$) and base precursor having the following structure (F) (0.72 g/m$^2$).

Comparative dye developer (structure X):

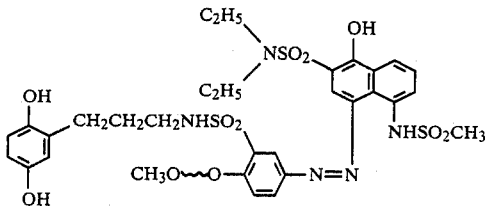

Active methylene group-containing compound (structure B):

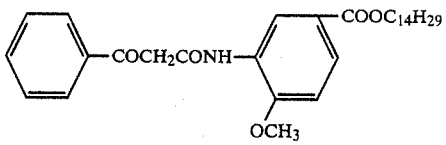

Auxiliary developer (structure C):

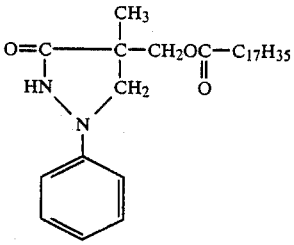

Anti-foggant (structure D):

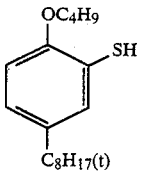

Surfactant (structure E):

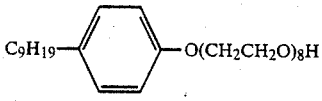

Base precursor (structure F):

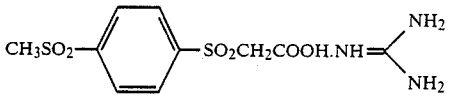

Light-sensitive coated material (A-2):

In the same manner as the manufacture of the light-sensitive coated material (A-1) with the exception that the same molar amount of the following comparative dye developer having the structure (Y) was used in the layer (1) instead of the compound having the structure (X), the light-sensitive coated material (A-2) was obtained.

Comparative dye developer (structure (Y):

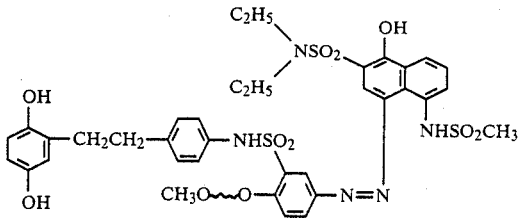

Light-sensitive coated materials (A-3) through (A-7) of the present invention were prepared as follows:

Light-sensitive coated material (A-3):

The same molar amount of Compound (1) of the present invention was added to the layer (1), instead of the compound having the structure (X) in the light-sensitive coated material (A-1), and other components were the same as those of the light-sensitive coated material (A-1).

Light-sensitive coated material (A-4):

The same molar amount of Compound (4) of the present invention was added to the layer (1), instead of the compound having the structure (X) in the light-sensitive coated material (A-1), and other components were the same as those of the light-sensitive coated material (A-1).

Light-sensitive coated material (A-5):

The same molar amount of Compound (8) of the present invention was added to the layer (1), instead of the compound having the structure (X) in the light-sensitive coated material (A-1), and other components were the same as those of the light-sensitive coated material (A-1).

Light-sensitive coated material (A-6):

The same molar amount of Compound (12) of the present invention was added to the layer (1), instead of the compound having the structure (X) in the light-sensitive material coated (A-1), and other components were the same as those of the light-sensitive material (A-1).

Light-sensitive coated material (A-7):

The same molar amount of Compound (19) of the present invention was added to the layer (1), instead of the compound having the structure (X) in the light-sensitive coated material (A-1), and other components were the same as those of the light-sensitive coated material (A-1).

Next, the following layer was provided on a paper support laminated with a titanium dioxide-dispersed polyethylene to prepare a dye-fixing material.

(1) A layer containing poly(methyl acrylate-co-N,N,N-trimethyl-N-vinylbenzylammonium chloride) (ratio of methyl acrylate to vinylbenzylammonium chloride = 1/1) (3.3 g/m$^2$) and gelatin (3.3 g/m$^2$).

Next, each of the above light-sensitive coated materials (A-1) through (A-7) was imagewise exposed with a tungsten lamp of 2000 luxes for 10 seconds. Afterwards, they were heated on a heat block heated at 140° C. for 20 seconds.

Next, the dye-fixing material was dipped in water and superposed on the above-treated sample in a face-to-face contact relation, followed heating on a heat block of 85° C. for 10 seconds. Afterwards, the dye-fixing material was peeled apart from the light-sensitive material to obtain a positive magenta image.

The density of the positive image to a green light was measured with a color densitometer for each sample. The results are given in the following Table 1.

TABLE 1

| Light-sensitive | Maximum density | Minimum density | Remarks | |
|---|---|---|---|---|
| A-1 | 1.89 | 0.49 | Comparison | |
| A-2 | 1.83 | 0.43 | | |
| A-3 | 1.85 | 0.32 | Compound (1) | Present invention |
| A-4 | 1.86 | 0.29 | Compound (2) | |
| A-5 | 1.83 | 0.28 | Compound (3) | |
| A-6 | 1.81 | 0.26 | Compound (12) | |
| A-7 | 1.84 | 0.26 | Compound (19) | |

Table 1 shows that the minimum density of the image formed by the use of the light-sensitive coated material containing the compound of the present invention is far smaller than that of the image formed by the use of the comparative light-sensitive coated material and that a sharp positive image of high discrimination is obtainable by the use of the compound of the present invention.

EXAMPLE 2

The following layers were provided on a polyethylene terephthalate film support in order to prepare comparative light-sensitive coated material (B-1) and light-sensitive coated material (B-2) of the present invention.

Light-sensitive coated material (B-1):

(1) A layer containing green-sensitive silver iodobromide (0.67 g of silver/m$^2$), benzotriazole silver (0.43 g of silver/m$^2$), comparative non-precursor type dye developer having the above-described structure (X) (0.44 g/m$^2$), gelatin (2.4 g/m$^2$), compound having the above-described structure (B) (0.61 g/m$^2$), auxiliary developer having the above-structure (C) (0.14 g/m$^2$), anti-foggant having the above-described structure (D) (0.23 g/m$^2$), compound having the above-described structure (E) (0.17 g/m$^2$), base precursor having the above-described structure (F) (0.69 g/m$^2$), and tricresyl phosphate (0.91 g/m$^2$).

(2) A layer containing gelatin (0.59 g/m$^2$) and base precursor having the above-described structure (F) (0.38 g/m$^2$).

(3) A layer containing blue-sensitive silver iodobromide (0.89 g of silver/m$^2$), benzotriazole silver (0.44 g/ of silver/m$^2$), dye developer (yellow) having the following structure (Z) (0.32 g/m$^2$), gelatin (1.92 g/m$^2$), compound having the above-described structure (B) (0.78 g/m$^2$), auxiliary developer the above-described structure (C) (0.17 g/m$^2$), anti-foggant having the above described structure (D) (0.27 g/m$^2$), compound having the above-described structure (E) (0.15 g/m$^2$), base precursor having the above-described structure (F) (0.52 g/m$^2$), and tricresyl phosphate (0.70 g/m$^2$).

(4) A layer containing gelatin (0.54 g/m$^2$) and base precursor having the above-described structure (F) (0.30 g/m$^2$).

Dye developer (yellow) (structure Z):

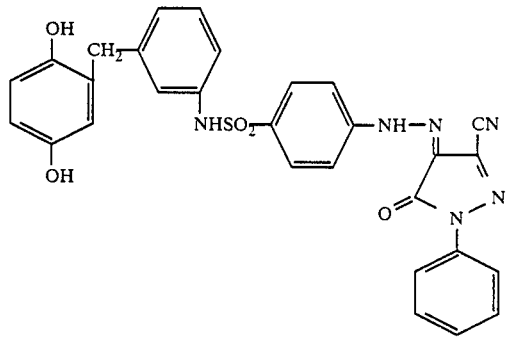

Light-sensitive coated material (B-2):

The same molar amount of Compound (6) of the pressent invention was added to the layer (1), instead of the compound having the structure (X) in the light-sensitive coated material (B-1), and other components were the same as those of the light-sensitive coated material (B-1).

Next, each of the above light-sensitive coated materials (B-1) and (B-2) was exposed with a tungsten lamp of 2000 luxes through a multicolor continuous wedge for 10 seconds. Afterwards, they were heated on a heat block heated at 140° C. for 50 seconds. Next, the same dye-fixing material as used in the Example 1 was dipped in water and superposed on the resulting sample in a face-to-face contact relation, followed by heating on a heat block of 90° C. for 18 seconds. Afterwards, the dye-fixing material was peeled apart from the light-sensitive material to obtain a positive two-color image comprising yellow and magenta colors.

The density of the positive image was measured with a color densitometer. The results (Dmax and Dmin) are given in the following Table 2. In addition, Table 3 shows an yellow component and a magenta component in the image moiety corresponding to the yellow-monochromatic exposed area.

TABLE 2

| Light-sensitive coated material | Gray-exposed area: Maximum density (Dmax) Yellow | Maximum density (Dmax) Magenta | Minimum density (Dmin) Yellow | Minimum density (Dmin) Magenta | Remarks |
|---|---|---|---|---|---|
| B-1 | 1.47 | 1.62 | 0.31 | 0.45 | Comparison |
| B-2 | 1.46 | 1.68 | 0.30 | 0.31 | Present invention |

TABLE 3

| Light-sensitive coated material | Yellow-monochromatic exposed area: Yellow | Magenta | Remarks |
|---|---|---|---|
| B-1 | 1.32 | 0.67 | Comparison |
| B-2 | 1.34 | 0.35 | Present invention |

Table 2 shows that the minimum density of the image formed by the use of the light-sensitive coated material (B-2) containing the dye developer of the present invention is smaller than that formed by the use of the comparative light-sensitive coated material (B-1) and that the high light part of the former is more highly white than the latter. In addition, it is noted from the results of Table 3 that the yellow-monochromatic image formed from the comparative light-sensitive coated material (B-1) is stained with a magenta dye and, therefore, the color separation is worse in the image than the light-sensitive coated material (B-2). On the other hand, the color separation is extremely improved in the light-sensitive coated material (B-2) of the present invention.

While the invention has been described in detail and with reference to specific embodiments thereof, it will be apparent to one skilled in the art that various changes and modifications can be made therein without departing from the spirit and scope thereof.

What is claimed is:

1. A method for forming an image comprising heating a light-sensitive material comprising a support having provided thereon at least a light-sensitive silver halide and a dye developer, said dye developer not releasing or forming a dye but developing silver halide to thereby render the dye developer non-diffusible, said heating being in the presence of a base and/or a base precursor after or simultaneously with image exposure to image-wise distribute a mobile non-oxidation type dye developer, wherein the dye developer is a compound having a dye moiety having a ballast group, which ballast group is split off upon heating in the presence of the base and/or base precursor, said dye developer also containing a developer moiety for the silver halide in its molecule, said dye developer being immobilized in said light-sensitive material by developing the silver halide, whereafter said ballast group splits off.

2. A method as claimed in claim 1, wherein the ballast group which is split off upon heating in the presence of the base and/or base precursor is an ester group having 5 or more carbon atoms in the total carbon atom number.

3. A method as claimed in claim 1, wherein the dye developer is a compound represented by the formula (I):

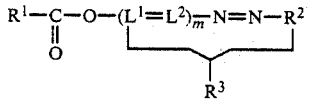

(I)

wherein $R^1$ represents an unsubstituted or substituted alkyl group, an unsubstituted or substituted aryl group, or an unsubstituted or substituted heterocyclic group, each having 4 or more carbon atoms; $L^1$ and $L^2$ each represents a methine group or a substituted methine group, or $L^1$ and $L^2$ form together a member of an at least partially unsaturated carbocyclic or heterocyclic ring system; n represents 1 or 2; $R^2$ represents

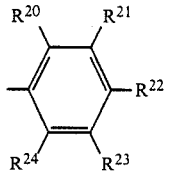

wherein $R^{20}$ through $R^{24}$ each represents a hydrogen atom, a halogen atom, a nitro group, a cyano group, or a substituted or unsubstituted alkyl, aryl, alkoxy, alkylsulfonyl, arylsulfonyl, carbamoyl, sulfamoyl, acylamino, alkylsulfonylamino, or arylsulfonylamino group; and $R^3$ is a group selected from the following formulae:

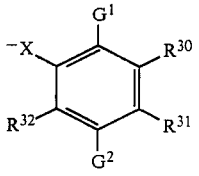

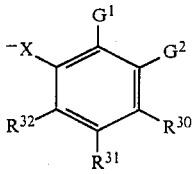

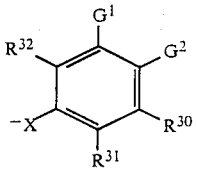

wherein X represents a single bond or a divalent residual group to bind the developer moiety and the dye moiety and this is bound to any part of $L^1$, $L^2$ and $R^2$; $G^1$ and $G^2$, which may be the same or different, each represents a hydroxyl group or a group capable of forming a hydroxyl group by the action with a nucleophilic reagent; $R^{30}$ through $R^{32}$ each represents a hydrogen atom, a halogen atom, a hydroxyl group, or a substituted or unsubstituted alkyl, aryl, alkoxy, aryloxy, acyl, acylamino, alkylsulfonylamino, arylsulfonylamino, alkylthio, carbamoyl, sulfamoyl, or arylthio group; and two of the adjacent X, $R^{30}$, $R^{31}$, and $R^{32}$ may form a condensed ring together with the residue of the molecule.

4. A method as claimed in claim 3, wherein the substituent for the substituted alkyl group, substituted aryl group, or substituted heterocyclic group for $R^1$ is a halogen atom, a nitro group, a cyano group, an alkoxy group, an aryloxy group, an alkylsulfonyl group, an arylsulfonyl group, a carbamoyl group, a sulfamoyl group, an acylamino group, an alkylsulfonyl group, or an arylsulfonylamino group.

5. A method as claimed in claim 3, wherein the substituent in the substituted alkyl, aryl, alkoxycarbonyl, aryloxycarbonyl, alkoxy, aryloxy, acylamino, alkylsulfonylamino, arylsulfonylamino, carbomoyl, sulfamoyl, alkylthio, arylthio, alkylsulfonyl, or arylsulfonyl group for $R^{40}$ through $R^{45}$ is a halogen atom, a nitro group, a cyano group, an alkoxy group, an aryloxy group, an alkylsulfonyl group, an arylsulfonyl group, a carbamoyl group, a sulfamoyl group, an acylamino group, an alkylsulfonylamino group, or an arylsulfonylamino group.

6. A method as claimed in claim 3, wherein the substituent in the substituted alkyl, aryl, alkoxy, alkylsulfonyl, arylsulfonyl, carbamoyl, sulfamoyl, acylamino, alkylsulfonylamino, or arylsulfonylamino group for $R^{20}$ through $R^{24}$ is a halogen atom, a nitro group, a cyano group, an alkoxy group, an aryloxy group, an alkylsulfonyl group, an arylsulfonyl group, a carbamoyl group, a sulfamoyl group, an acylamino group, an alkylsulfonylamino group, or an arylsulfonylamino group.

7. A method as claimed in claim 3, wherein the substituent in the substituted alkyl, aryl, alkoxy, aryloxy, acyl, acylamino, alkylsulfonylamino, arylsulfonylamino, alkylthio, carbamoyl, sulfamoyl, or arylthio group for $R^{30}$ through $R^{32}$ is a halogen atom, a nitro group, a cyano group, an alkoxy group, an aryloxy group, an alkylsulfonyl group, an arylsulfonyl group, a carbamoyl group, a sulfomoyl group, an acylamino group, an alkylsulfonylamino group, or an arylsulfonylamino group.

8. A method as claimed in claim 3, wherein the divalent residual group for X is —alkylene—, —O—, —alkylene—O—, —alkylene—S—, $$-\overset{O}{\overset{\|}{C}}-,\ -\text{alkylene}-\overset{O}{\overset{\|}{C}}-,$$

$-SO_2-$, —alkylene—$SO_2$—, —NHCO—, —alkylene—NHCO—, —$NHSO_2$—, —alkylene—$SO_2NH$—, —alkylene—$NHSO_2$—, —alkylene—CONH—, —NHCONH—,

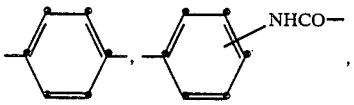

-continued

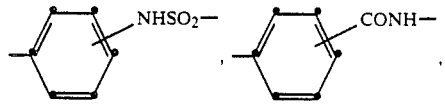

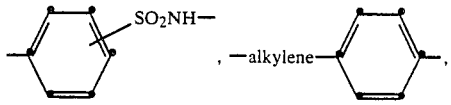

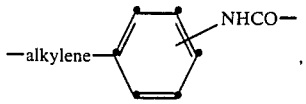

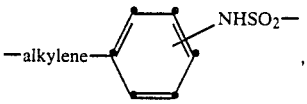

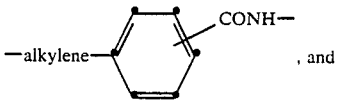

, and

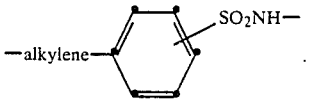

9. A method as claimed in claim 1, wherein the dye developer is used in an amount of from 10 mg to 15 g per $m^2$.

10. A method as claimed in claim 9, wherein the dye developer is used in an amount of from 15 mg to 5 g per $m^2$.

* * * * *